US007486246B1

(12) United States Patent
Leonard

(10) Patent No.: US 7,486,246 B1
(45) Date of Patent: Feb. 3, 2009

(54) EASY SATELLITE FINDER

(76) Inventor: John Michael Leonard, 140 W 29th St. #101, Pueblo, CO (US) 81008

( * ) Notice: Subject to any disclaimer, the term of this patent is extended or adjusted under 35 U.S.C. 154(b) by 0 days.

(21) Appl. No.: 11/500,659

(22) Filed: Aug. 8, 2006

Related U.S. Application Data

(60) Provisional application No. 60/706,893, filed on Aug. 9, 2005.

(51) Int. Cl.
*H01Q 3/00* (2006.01)

(52) U.S. Cl. ..... 343/760; 343/894

(58) Field of Classification Search ..... 343/757, 343/760, 894; 342/359
See application file for complete search history.

(56) References Cited

U.S. PATENT DOCUMENTS 6,366,253 B1 * 4/2002 Hemmingsen, II ..... 343/760
6,580,391 B1 6/2003 Kepley
6,661,373 B1 12/2003 Holliday
6,683,581 B2 1/2004 Matz
6,795,033 B2 * 9/2004 Matz et al. ..... 343/760
6,889,421 B1 5/2005 Matz
6,906,673 B1 6/2005 Matz
6,937,188 B1 8/2005 Saunders
6,956,526 B1 10/2005 Lundstedt, Jr.

* cited by examiner

*Primary Examiner*—Hoang V. Nguyen

(57) ABSTRACT

A compact battery operated device (FIG. 2) for wirelessly detecting an RF signal for the proper alignment of a satellite antenna (FIG. 1). That also incorporates ease of use by quickly attaching and de-attaching using straps (26), magnet or spring loaded clip. An antenna extending from the device receives the signal and converts it to a display, speaker (32) or light (30) by way of a sensitivity adjuster (34).

1 Claim, 1 Drawing Sheet

EASY SATELLITE FINDER

CROSS-REFERENCE TO RELATED APPLICATIONS

This application claims the benefit of provisional patent application Ser. No. 60/706,893, filed 2005 Aug. 9 by the present inventor.

FEDERALLY SPONSORED RESEARCH

Not Applicable

SEQUENCE LISTING OR PROGRAM

Not Applicable

BACKGROUND OF THE INVENTION

1. Field of Invention

This invention generally relates to satellite alignment meters, specifically an improved method for aiming a stationary satellite dish, without the use of wires.

2. Prior Art

Satellite dish installers commonly use some type of meter to measure incoming signal strength for proper alignment of the fixed position satellite dish. These meters are connected by wires to the satellite dish receiver. Other ways of pointing a dish do not require a received signal but are time consuming to execute and require some type of wire connected meter to verify results, as demonstrated in the following U.S. Pat. Nos. 6,580,391 (2003), 6,661,373 (2003), 6,683,581 (2004), 6,889,421 (2005), 6,906,673 (2005), 6,937,188 (2005), and 6,956,526 (2005).

The unique difference between current patents and my device is wires. No wires are used to connect my device. The use of wires present a number of disadvantages:

a) The constant connection and disconnection of wires causes connection failure on the device being used, and is a common reason for failure and replacement of device.

b) The need to access wires under the receiver housing is time consuming.

c) In many cases, there is a need to cut and tap into the wire. This is also time consuming and in many cases allows outside weather to penetrate the repaired cut after the meter device has been removed.

d) When using a receiver that is not located near the dish to detect the signal, some kind of device is needed to transmit the sound of the on screen meter to the outside location where the dish is being aligned by the installer. The use of this system, as referred to in the previously mentioned patents, is time consuming and also requires the use of connected wiring.

OBJECTS AND ADVANTAGES

Accordingly, several objects and advantages of the invention are:

a) To provide a device that does not require the constant connection and disconnection of wires.

b) To provide a device that does not require the dismantling of the receiver on the dish arm to get to wires.

c) To provide a device that does not require the cutting of wires to obtain a signal.

d) To provide a device that does not promote the weathering and failure of a repaired cut wire.

e) To provide a device that helps to avoid future service calls because of the tempering involved to obtain a signal with other devices.

f) To provide a device for non-qualified people to use with ease.

g) To provide a device that can be used repeatedly without damage to the device.

Further objects and advantages will become apparent from a consideration of the ensuing description and drawings.

SUMMARY

In accordance with the present invention, a signal detector comprises a small thin body in the shape of a flat rectangle made of plastic which holds an electronic device and batteries, and an antenna that protrudes from the device. There are straps attached to the device for holding the device to the arm of the LNB, so that the antenna may be positioned in front of the LNB receiver.

DRAWINGS—FIGURES

DRAWINGS—REFERENCE NUMERALS

| | | | |
|---|---|---|---|
| 10 | dish | 12 | cable or wire leading to LNB |
| 14 | LNB | 16 | receiver arm |
| 18 | dish support | 20 | LNB receiver |
| 22 | antenna | 24 | flexible antenna holder |
| 26 | velcro straps | 28 | battery compartment |
| 30 | signal light | 32 | signal indicator speaker |
| 34 | sensitivity adjuster | | |
| 36 | case | 38 | easy satellite finder |

DETAILED DESCRIPTION—PREFERRED EMBODIMENT—FIGS. 1,2

Figure 1:
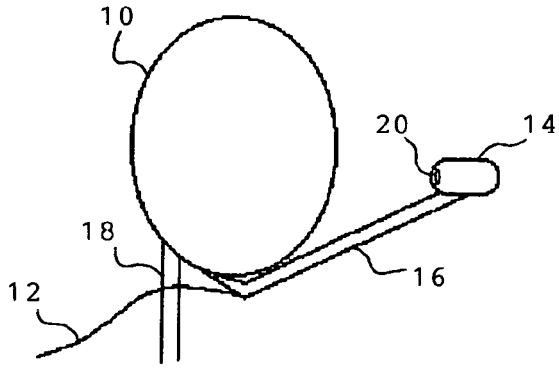
FIG. 1 shows the basic satellite dish with receiver.
Figure 2:
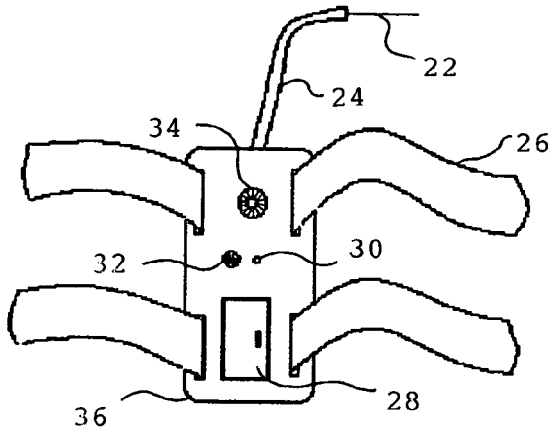
FIG. 2 shows the "EASY SATELLITE FINDER" device.
Figure 3:
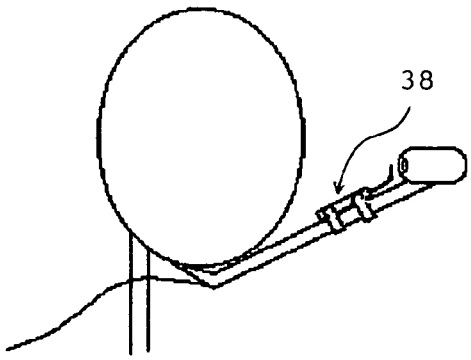
FIG. 3 shows the device attached to the dish and receiver.

A preferred embodiment of the present invention is illustrated in FIG. 2. The case 36 is approximately 4.5 inches long by 2.25 inches wide and has a thickness of approximately 0.5 inch. Running through the case are straps 26, that are used for temporarily securing the case 36 to the receiver arm 16. The preferred material for the straps 26 is velcro cloth and the preferred material for the case 36 is plastic.

On the case 36 is a removable door 28 for a battery compartment, and a flexible antenna holder 24, protruding from the short side, approximately 6 inches long, ending with a wire or metal antenna 22, approximately 1 inch long. There is also a knob 34 for sensitivity adjustments, a speaker 32 for an audible tone, and a light 30 for indicating proper alignment due to signal strength increase when the dish 10 is aimed at a satellite.

OPERATION—PREFERRED EMBODIMENT—FIGS. 1,2,3

The invented device is attached to the arm 16 of the LNB 14 by use of straps 26. Then the antenna 22 of the invented device is positioned in front of the LNB receiver 20 by using the flexible antenna holder 24 protruding from the device. Shown in FIG. 3-38.

The dish 10 can then be moved into the general direction of the anticipated signal allowing the device to register varying indications of a signal by use of light 30 and sound 32, using a sensitivity adjuster 34 to pinpoint the highest signal location. Once this location has been located the dish assembly can be secured in that position and the invented device can quickly be removed by undoing the straps 26.

DESCRIPTION—ALTERNATIVE EMBODIMENT

The description of alternative embodiments is discussed in the conclusion, ramifications, and scope of invention section.

OPERATION—ALTERNATIVE EMBODIMENT

The operation of alternative embodiments is discussed in the conclusion, ramifications, and scope of invention section.

CONCLUSION, RAMIFICATIONS, AND SCOPE

Accordingly the reader will see that, according to the invention, I have provided that my device does not hook up to the cable or wire, and it is a totally independent radio frequency detector that can be temporarily attached to the LNB arm and it is battery operated. The dish doesn't have to be connected to a power source, and doesn't have to have any wires attached to it. The device can quickly be attached and de-attached by using an integrated velcro strap, magnet, spring loaded clip or similar device.

While the above description contains many specificities, these should not be construed as limitations on the scope of this invention, but as exemplifications of the presently preferred embodiments thereof. Many other ramifications and variations are possible within the teachings of the invention. For example, a wireless device using the same principles may be miniaturized to be attached directly to the front of the LNB receiver face, thereby not using the LNB arm to hold the device and not requiring an extended antenna to be placed in front of the LNB receiver. Thus the scope of the invention should be determined by the appended claims and their legal equivalents, and not by the examples given.

I claim:

1. A device for assessing a degree of alignment of an antenna with a satellite comprising: a portable housing including a receiver and antenna for detecting an RF signal of proper wavelength and converting that signal to an audible tone, light, or display, and while receiving the RF signal for alignment, the device is free of attached wires to the antenna being aligned, and is an independent wireless RF detector.

* * * * *